US008992822B2

(12) United States Patent
Filzwieser et al.

(10) Patent No.: US 8,992,822 B2
(45) Date of Patent: Mar. 31, 2015

(54) METHOD FOR COOLING A METALLURGICAL FURNACE

(75) Inventors: Andreas Filzwieser, Proleb (AT); Iris Filzwieser, Proleb (AT)

(73) Assignee: Mettop GmbH, Leoben (AT)

( * ) Notice: Subject to any disclaimer, the term of this patent is extended or adjusted under 35 U.S.C. 154(b) by 447 days.

(21) Appl. No.: 13/322,398

(22) PCT Filed: May 21, 2010

(86) PCT No.: PCT/EP2010/057041

§ 371 (c)(1),
(2), (4) Date: Feb. 3, 2012

(87) PCT Pub. No.: WO2010/136403

PCT Pub. Date: Dec. 2, 2010

(65) Prior Publication Data

US 2012/0138271 A1 Jun. 7, 2012

(30) Foreign Application Priority Data

May 28, 2009 (AT) ..... A 833/2009

(51) Int. Cl.
*F28D 15/00* (2006.01)
*F27D 9/00* (2006.01)
*F27B 3/24* (2006.01)

(52) U.S. Cl.
CPC ... *F27D 9/00* (2013.01); *F27B 3/24* (2013.01); *F27D 2009/001* (2013.01)
USPC ..... 266/44; 165/104.19

(58) Field of Classification Search
CPC ..... F27B 3/24; F27D 2009/001; F27D 9/00
USPC ..... 266/46; 165/104.19, 104.31; 432/26, 432/77, 116, 85, 233, 106
See application file for complete search history.

(56) References Cited

U.S. PATENT DOCUMENTS 2,275,515 A * 3/1942 Dunham ..... 122/6 R
2,744,742 A * 5/1956 Lord ..... 110/260
4,141,154 A * 2/1979 Buchner ..... 34/429
5,290,468 A * 3/1994 Turcotte et al. ..... 252/76

OTHER PUBLICATIONS

English translation of Application No. DE1103366, Published Mar. 30, 1961, Assigned to Steinmueller GmbH L & C.

* cited by examiner

*Primary Examiner* — Scott Kastler
*Assistant Examiner* — Michael Aboagye
(74) *Attorney, Agent, or Firm* — Workman Nydegger

(57) ABSTRACT

In a method for cooling a metallurgical furnace having at least one cooling element which is flown through by a cooling mediums, a cooling medium that contains at least one ionic liquid, and preferably consists thereof, is carried through the cooling element, thereby preventing the problems that are associated with water cooling, such as the risk of hydrogen explosions and damage to the furnace lining.

6 Claims, 1 Drawing Sheet

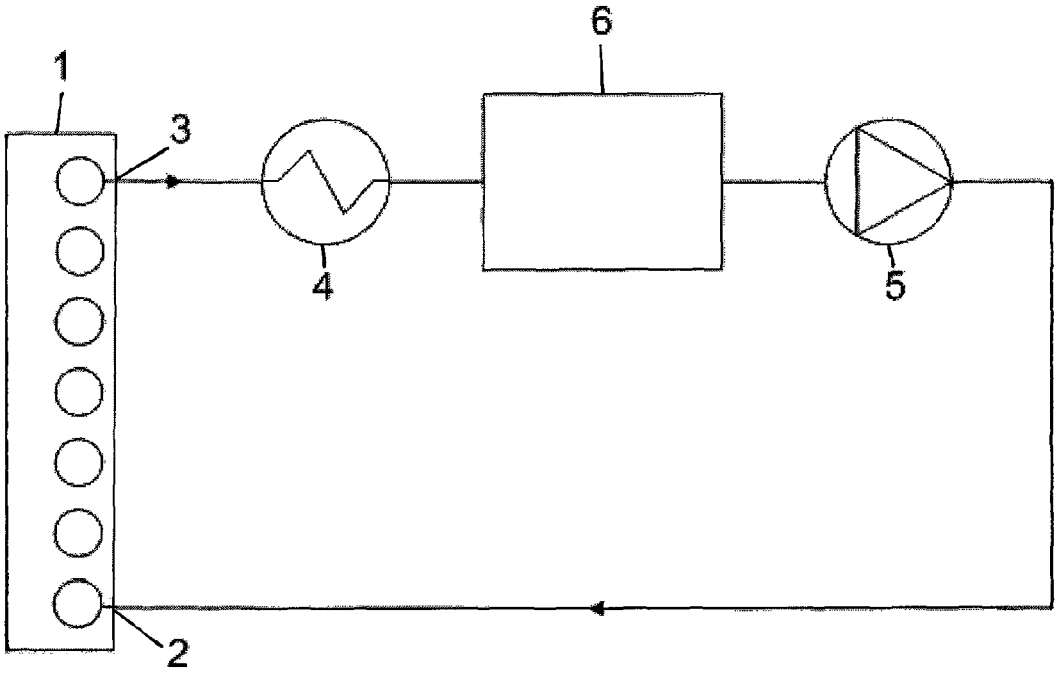
1
2
3
4
5
6

METHOD FOR COOLING A METALLURGICAL FURNACE

BACKGROUND

The invention relates to a method for cooling a metallurgical furnace having at least one cooling element which is flown through by a cooling medium. The invention further relates to a cooling circuit system for metallurgical furnaces, comprising at least one cooling element with a feed and a discharge for a cooling medium, a heat exchanger and a recirculation pump.

Water is usually used as a cooling medium in cooling elements in metallurgical furnaces. In prior art there are various designs of such cooling elements, which differ from each other in terms of geometry and guidance of the cooling medium. The cooling elements may be installed at the wall, in the wall or at the tap hole, with the ones in the furnace wall providing for the most intensive cooling.

For these very effective cooling elements in the furnace wall, there are available in general two embodiments, namely, one with water flow within the furnace shell, and the other one with water flow outside of the furnace shell. The cooling elements with water flow within the furnace shell are preferably used in flash smelters and electric furnaces as these provide for a great amount of heat transfer, without—as it is the case with the cooling elements with water flow outside of the furnace shell—a plurality of openings in the furnace shell being required.

The great disadvantage of the cooling elements with water flow in the furnace shell, however, is the cooling medium water itself. In the case of damage at the cooling element or a breaking of the cooling element, respectively, and the leakage of water associated therewith, water may enter the furnace.

Due to the reaction of water and molten metal and the hydrogen reactions associated therewith, there is given a high risk of explosion (oxyhydrogen reaction), in particular if the leakage is situated in the cooling element and, hence, the site of the water leakage is situated underneath the bath level. These explosions, due to the reaction with water, may lead to the destruction of the furnace.

Water entering the furnace may further lead to big problems with the refractories of the furnace lining if—as is common in the non-iron metal and ferro-alloy industry—MgO-containing material is used. Upon contact with water, the reaction of periclase (MgO) into brucite ($Mg(OH)_2$) takes place, i.e., hydration, and an increase in volume associated therewith of up to 115%:

$$MgO+H_2O \rightarrow Mg(OH)_2$$

The increase of volume due to this reaction leads to cracks and in the worst case to sand-like disintegration of the refractory material. Further, the increase of volume causes uncontrolled movement of the refractory lining, which may impair the furnace shell.

Another big problem may occur when the furnace is heated. In the course of this the water, i.e., the residual moisture, leaves the refractory bricks. In order to minimize the risk of hydration of the MgO-containing bricks, which tends to occur in a temperature range from about 40 to 180° C., this temperature range is passed as fast as possible.

Crucial, however, is the region in the vicinity of the cooling elements. Due to the temperature of the cooling water, the temperature of the water-cooled cooling elements is significantly lower (<100° C.) than that of the adjoining refractory bricks, so that this may lead to water condensing between refractories and cooling element. This, in turn, will result in hydration and damage in this area.

SUMMARY

The invention aims at preventing the above mentioned disadvantages and problems of the prior art and has as its object to provide a method for cooling metallurgical furnaces, wherein the risk of hydrogen explosions and damage to the refractory material is eliminated.

According to the invention, this object is achieved with a method of the type initially mentioned in that a cooling medium that contains at least one ionic liquid, and preferably consists thereof, is carried through the cooling element.

BRIEF DESCRIPTION OF THE DRAWING

The invention is in the following described in more detail by way of an example and the drawing, wherein FIG. 1 illustrates a cooling circuit system according to an embodiment of the invention in a schematic representation.

DETAILED DESCRIPTION

Ionic liquids that contain exclusively ions are by definition salts that are liquid at temperatures below 100° C., without the salt being dissolved in a solvent like water.

Ionic liquids contain as cations, which may in particular also be alkylated, for example imidazolium, pyridinium, pyrrolidinium, guanidinium, uronium, thiouronium, piperidinium, morpholinium, ammonium or phosphonium, which may be combined with a variety of different anions such as, e.g., sulphate-derivatives, phosphate-derivates, halogenides, fluorinated anions, for example, tetrafluoroborate, hexafluoroborate, trifluoroacetate, trifluoromethane sulfonate or hexafluorophosphate, sulfonates, phosphinates or tosylates. Organic anions such as imides and amides may form ionic liquids as well.

Many representatives of this class of compounds are characterized, even without having been structurally optimized, by comparably high heat capacities and heat storage densities as well as high thermal stabilities. Furthermore, ionic liquids have negligibly low vapour pressure or none at all, respectively.

Ionic liquids are used as solvents in chemical process engineering as well as biotechnology, as electrolytes in capacitors, fuel cells and batteries or as thermal fluids for heat storage, for example in solar-thermal plants.

In the method according to the invention there is used, according to a preferred embodiment, an ionic liquid, which is liquid in a temperature range between room temperature and 600° C., preferably between room temperature and 300° C. The ionic liquid may be used in any kind of cooling element, e.g., in conventional copper cooling elements.

According to a preferred embodiment of the invention, the ionic liquid is selected from compounds containing phosphorus, boron, silicon and/or metals. As an example of such an ionic liquid triethyl methyl phosphonium-dibutyl phosphate may be cited.

These preferred ionic liquids have the advantage that upon thermal degradation (in air) they form non-volatile, solid oxides. In this way, the ionic liquid is not only incombustible below its decomposition point, but it is flame-resistant or even completely incombustible beyond this point.

Another advantage of the method according to the invention is that the cooling effect may be well adjusted by the ionic liquid used as (an integral part of) the cooling medium. At the tap hole of the furnace, for example, higher temperatures may be realized by less cooling. This leads, e.g., in the production of copper to a lower SO2 vapour pressure in the blister copper and thus also to a reduction in gas formation.

The method according to the invention is further advantageous in heating the furnace. As ionic liquids may also be heated to temperatures >100° C., it is thus possible to adjust the temperature of the cooling elements correspondingly high already when heating the furnace. Therefore, no water condensation in the region between refractory bricks and cooling element occurs, and any hydration and damage to the furnace lining associated therewith can be prevented.

Preferably, the cooling medium is carried in a closed cooling circuit. According to a preferred embodiment of the method, the cooling circuit is coupled to steam generation. For this purpose, the cooling medium is expediently guided through a heat exchanger in order to discharge heat.

The invention further relates to a cooling circuit system for metallurgical furnaces, comprising at least one cooling element with a feed and a discharge for a cooling medium, a heat exchanger and a recirculation pump, characterized in that it comprises a cooling medium reservoir with an ionic liquid.

According to another aspect the invention relates to the use of an ionic liquid for cooling metallurgical furnaces, wherein the ionic liquid is preferably selected from compounds containing phosphorus, boron, silicon and/or metals.

EXAMPLE

In a metallurgical furnace of laboratory scale 10 kg of copper were molten. The temperature of the molten copper bath was about 1150° C. In order to simulate the event of a damage and leakage of the cooling medium from a defect cooling element, a steel tube was introduced into the molten bath and an ionic liquid was introduced by means of a peristaltic pump below the bath level. As ionic liquid 2 liters of triethyl methy phosphonium dibutyl phosphate were used. The flow rate of the ionic liquid was 200 ml/min.

In contrast to the violent reactions, i.e., explosions and expulsion of the molten material that would have been expected upon use of water, with the ionic liquid, apart from rather infrequent, slight sputtering of the liquid copper, no bath movements, in particular no explosions, did occur.

In FIG. 1 a closed cooling circuit system according to the invention is depicted. The cooling medium that contains at least one ionic liquid enters the cooling element 1 via the feed 2 at a temperature T1, e.g., from room temperature up to about 500° C., and flows through the cooling channels arranged in the cooling element 1 until it again exits the cooling element 1 via the discharge 3 at elevated temperature T2 ($T2=T1+\Delta T$; for example $\Delta T=0$ to 600° C.). In a heat exchanger 4, the cooling medium is again cooled down to the temperature T1 desired for the respective cooling application in the cooling element 1, wherein the released amount of heat $\Delta T$ may be used, e.g., for the generation of steam. A pump 5 is arranged downstream of the heat exchanger 4 for circulating the cooling medium. In the cooling circuit there is further provided a reservoir 6, for example between the heat exchanger 4 and the pump 5, in which the cooling medium containing the ionic liquid is collected, and from which cooling medium may be removed, if required, or to which to the cooling medium can be added.

The invention claimed is:

1. A method for cooling a metallurgical furnace, comprising:

flowing a cooling medium through at least one cooling element of the metallurgical furnace, wherein the cooling medium contains at least one ionic liquid carried through the cooling element, and wherein the ionic liquid contains a salt that is liquid at a temperature below 100° C. without being dissolved in water and selected from the group consisting of compounds containing phosphorus, boron, silicon and/or metals;

compounds containing at least one cation selected from the group consisting of alkylated cations, imidazolium, pyridinium, pyrrolidinium, guanidinium, uronium, thiouronium, piperidinium, morpholinium, ammonium and phosphonium; and compounds containing at least one cation selected from the group consisting of sulphate-derivatives, phosphate-derivates, halogenides, fluorinated anions, tetrafluoroborate, hexafluoroborate, trifluoroacetate, trifluoromethane sulfonate, hexafluorophosphate, sulfonates, phosphinates or tosylates, imides and amides.

2. A method according to claim 1, wherein the cooling medium is carried in a closed cooling circuit.

3. A method according to claim 1, wherein the cooling medium is guided through a heat exchanger in order to discharge heat.

4. A method according to claim 1, wherein the cooling medium is used for cooling a metallurgical furnace for the production of copper or ferro alloys.

5. A method according to claim 1, wherein the cooling medium consists of at least one ionic liquid.

6. A method according to claim 1, further comprising using the heat exchanger to generate steam.

* * * * *